United States Patent [19]

Patel et al.

[11] 4,196,237

[45] Apr. 1, 1980

[54] HIGH HARDNESS COPPER-ALUMINUM ALLOY FLAME SPRAY POWDER

[75] Inventors: Mahesh S. Patel, Albertson; Joseph F. Quaas, Island Park, both of N.Y.

[73] Assignee: Eutectic Corporation, Flushing, N.Y.

[21] Appl. No.: 849,263

[22] Filed: Nov. 7, 1977

Related U.S. Application Data

[62] Division of Ser. No. 706,253, Jul. 19, 1976, abandoned.

[51] Int. Cl.[2] ..... B05D 1/08

[52] U.S. Cl. ..... 427/419.1; 75/251; 427/423; 428/667

[58] Field of Search ..... 428/621, 558, 556, 564, 428/568; 75/0.5 A, 0.5 AA, 0.5 AB, 0.5 B, 0.5 BA, 0.5 BB, 159, 162, 251; 427/190, 191, 192, 423, 419 R

[56] References Cited

U.S. PATENT DOCUMENTS

| | | | |
|---|---|---|---|
| 1,481,782 | 1/1924 | Iytaka | 75/159 |
| 2,430,419 | 11/1947 | Edens | 75/162 UX |
| 2,489,529 | 11/1949 | Grange | 75/159 X |
| 2,798,826 | 7/1957 | Klement | 75/159 X |
| 2,988,807 | 6/1961 | Boggs | 427/423 X |
| 3,416,915 | 12/1968 | Mikawa | 75/159 |
| 3,428,442 | 2/1969 | Yurasko | 427/423 X |
| 3,941,584 | 3/1976 | Tundermann et al. | 75/0.5 A X |
| 3,947,607 | 3/1976 | Gazzard et al. | 427/423 X |
| 4,019,875 | 4/1977 | Dittrich | 427/423 X |

FOREIGN PATENT DOCUMENTS

| | | | |
|---|---|---|---|
| 802044 | 9/1958 | United Kingdom | 75/159 |

*Primary Examiner*—Shrive P. Beck

*Attorney, Agent, or Firm*—Hopgood, Calimafde, Kalil, Blaustein and Lieberman

[57] ABSTRACT

A copper-aluminum alloy flame spray powder is provided consisting essentially by weight of 0 to about 5% Fe, about 2% to 8% Ni, about 5% to 15% Al, and the balance essentially copper, a coating produced from said powder being characterized by improved as-sprayed hardness in combination with resistance to oxidation and galling.

1 Claim, 3 Drawing Figures

HIGH HARDNESS COPPER-ALUMINUM ALLOY FLAME SPRAY POWDER

This is a division of copending application Ser. No. 706,253, filed July 19, 1976 now abandoned.

This invention relates to an aluminum bronze flame spray alloy powder and, in particular, to an aluminum bronze flame spray powder having improved as-sprayed hardness in combination with good resistance to wear and to galling.

State of the Art

Aluminum bronze flame spray powders are known for producing metal coatings on metal substrates which exhibit lubricity and resistance to oxidation and galling. A typical alloy which is generally used as an atomized powder consists essentially by weight of about 2% Fe, 10% Al, and the balance essentially copper, for example 88%.

A preferred method of producing an adherent coating of the foregoing alloy is first to spray a layer of a bonding metal onto a metal substrate and then follow this with a spray coating of the aluminum bronze alloy. A particular bond coating metal is a metal powder formed by agglomerating nickel powder with aluminum powder using a resin as a binding agent. The agglomerated powder may range in composition by weight from about 3% to 15% Al (preferably 3% to 10%) and the balance essentially nickel. A bond coating produced from the Ni-Al system exhibits good adherence with the metal substrate and serves as a foundation layer to which the aluminum bronze alloy strongly adheres. Thus, a fairly thick coating of the aluminum bronze alloy can be applied which can be easily machined with a carbide tip tool bit.

One of the disadvantages of the foregoing aluminum bronze composition is that it has a relatively low hardness which ranges from about 65 to 70 Rb which limits the use of such coatings in certain applications.

There is a need for aluminum bronze coatings of higher hardness while still retaining lubricity of the coating in combination with resistance to galling and oxidation.

We have now discovered an improved aluminum bronze flame spray powder which provides higher as-sprayed hardness than obtained heretofore by adding a controlled amount of nickel to the aluminum bronze composition.

OBJECTS OF THE INVENTION

It is thus an object of the invention to provide an aluminum bronze flame spray powder characterized by improved as-sprayed hardness.

Another object of the invention is to provide a method for producing an adherent aluminum bronze coating in a metal substrate characterized by improved as-sprayed hardness.

These and other objects will more clearly appear when taken in conjunction with the following disclosure and the accompanying drawing, wherein.

STATEMENT OF THE INVENTION

As one embodiment of the invention, we provide an aluminum bronze flame spray alloy powder consisting essentially by weight of 0 to about 5% Fe, about 2% to 8% Ni, about 5% to 15% Al and the balance essentially copper. Preferably, the composition consists essentially of 0 to 3% Fe, about 4% to 6% Ni, about 8% to 12% Al and the balance essentially copper.

However, broadly speaking, the amount of nickel added should be at least sufficient to raise the as-sprayed hardness to at least 10% higher than the hardness of the as-sprayed alloy without nickel.

We have found that, by working over the foregoing ranges of nickel, markedly improved as-sprayed hardness is obtainable as compared to the alloy without nickel. This will be clearly apparent by referring to FIG. 1 which shows an increase in as-sprayed hardness when nickel is added to the alloy over the range of about 2% to 8% Ni, and particularly over the range of about 4% to 6% Ni.

The presence of nickel does not adversely affect the resistance of the alloy to oxidation and wear so that improved hardness is obtained in combination with the foregoing properties. Also, the addition of nickel does not change the attractive yellow aluminum bronze color. Thicknesses of up to about 0.125 inch and higher can be obtained which adhere strongly to the metal substrate by employing a bond coat of another metal as the foundation layer, the bond coat generally having a thickness of about 0.005 to 0.015 inch. The aluminum bronze coating may range in thickness from about 0.005 to 0.125 inch and generally from about 0.01 to 0.1 inch.

Figure 2:
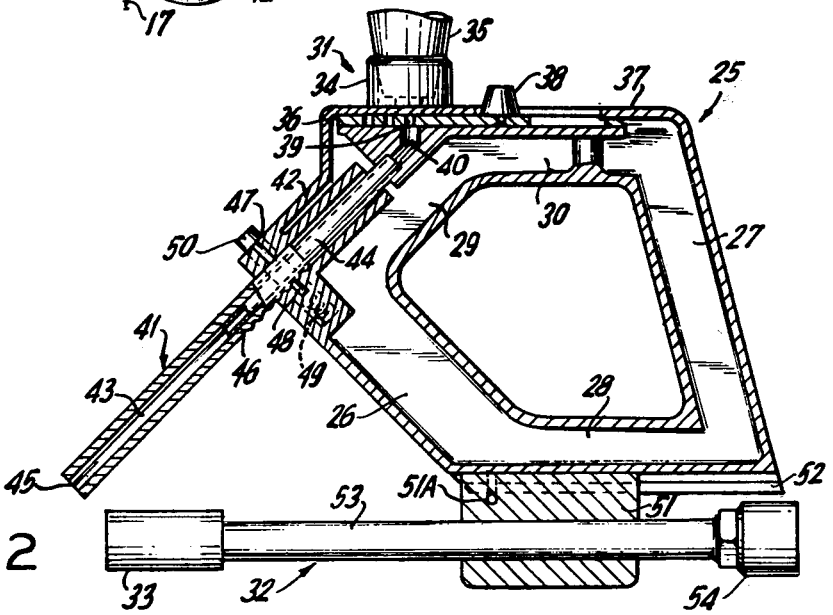
FIG. 2 depicts one type of a gravityfed metal spray gun which may be employed in producing a sprayed-on coating.

The aluminum bronze powder is preferably employed in the atomized form, this type of powder having exceptionally good free flowing properties. Such powder is particularly adapted for use in gravity fed torches as shown in FIG. 2. A preferred size of powder is one which ranges in average size substantially from about minus 100 mesh to plus 325 mesh and, more preferably, substantially from about minus 140 mesh to plus 325 mesh.

In producing a layer of the bronze alloy on a metal substrate, the substrate is first cleaned in the usual manner followed by shot blasting with steel grit or other mechanical operation and a foundation layer of a bonding metal applied by flame spraying.

A preferred bonding metal is a powder made up of agglomerates of metallic nickel and aluminum referred to hereinbefore. This powder is produced by mixing nickel with aluminum powder in a solution of an evaporatable organic solvent containing a binding resin, e.g. a phenolic resin (such as phenolformaldelhyde) dissolved in ethyl alcohol, methyl methacrylate, polyvinyl chloride, polyvinyl alcohol, and the like, such that, when the organic solvent is evaporated and agglomerated, a powder containing by weight anywhere from about 1% to 5% of the resin is obtained, preferably 3% by weight, in the form of agglomerates. The agglomerates are broken up by passing them through screens to provide a powder ranging substantially from about minus 100 mesh to plus 325 mesh and, more preferably, substantially from about minus 140 mesh to plus 325 mesh.

As stated earlier, the agglomerate excluding the resin may contain 3% to 15% aluminum and the balance essentially nickel (preferably 3% to 10% Al, such as 6% Al). The aluminum powder is adhesively bonded to the nickel powder by the resin, the aluminum powder size not exceeding about one-half the average size of the nickel powder, and preferably not exceeding one-quarter the average size of said nickel powder. The nickel powder may range from about 60 to 80 microns in size and the aluminum powder less than about 15 microns in size, e.g. 2 to 10 microns average size.

The Ni-Al foundation layer or bond coat may be sprayed using various types of flame spray torches well known in the art. As regards such torches, the powder formulation is injected into the stream of burning gas and emitted from the torch and applied to the metal substrate.

The atomized aluminum bronze powder may similarly be sprayed with the type of torches referred to hereinabove. A preferred torch is the gravity fed torch shown in FIG. 2 which is described in U.S. Pat. No. 3,620,454.

Referring to FIG. 2, the torch 25 has a housing in the shape of a five-sided polygon with one leg of the polygon arranged as a handle portion 27, another leg as a base portion 28, a further leg as a feed portion 29, and another leg of the polygon as the top portion of the torch. The housing 26 has coupled to it a powder feed assembly 31 and a flame assembly 32 to which is coupled nozzle 33.

The top portion 30 is provided with a fitting 34 adapted to receive a receptacle 35 (shown fragmentarily) for holding the alloy powder, a metering device being employed to control powder feed comprising a feed actuator plate 36 slidably mounted in a slot 37 located in the housing top portion 30 below fitting 34. Feed plate 36 is provided with a knob 38 which protrudes upwardly above the housing and permits the sliding of feed plate 36 reciprocally toward and away from housing feed portion 29.

The powder flows by gravity unhindered through circular orifices which may range in size from 0.075 to 0.120 inch for different alloy powders, the flow being maintained substantially constant over a mesh size range of minus 100 to plus 300 mesh. Atomized powder being spherical in shape is particularly adapted to this type of gravity fed gun.

In achieving the desired flow rate, feed plate 36 is selectively aligned with powder flow orifice 39 to control variably the flow rate of the powder from receptacle 35 through flow orifice 39 through conduit 40 and through variable spray control assembly 41. Assembly 41 has a housing 42 which holds a powder feed tube 43 and having a central core hollow cylinder 44 slidably and telescopically fitted within feed tube 43 and communicating directly with powder flow conduit 40 to deliver powder directly by gravity to feed tube 43, the powder then flowing through discharge end 45. A portion of the outer surface of feed tube 43 is provided with indexing means or grooves 46 which through latching assembly 47 enables the setting of powder feed tube 43 in order to locate discharge end 45 at the correct distance from the flame end of nozzle 33. The latching assembly comprises a holding pin 48 that is normally urged toward one of the indexing grooves 46 by spring 49, the holding pin 48 being actuated by rod 50 in making the setting. Thus, by depressing rod 50, the pin is moved out of contact with one of the indexing grooves and tube 43 set according to the desired position.

The flame assembly 32 is supported by sliding element 51 which can be lockingly moved along a track 52 located at the bottom leg of housing 26, a locking pin 15A being provided as shown. Gas flow tube 53 is fixedly held by sliding element 51 and may be factory set, one end of the tube having a connector 54 for attaching to a source of oxygen and acetylene.

The powder flows down tube 43 and is discharged at 45 into the flame issuing from nozzle 33.

The bond coat produced with the foregoing type of torch generally has a thickness of about 0.005 to 0.015 inch. The aluminum bronze coating is sprayed onto the bond coat to a thickness of about 0.08 inch.

As illustrative of the invention, the following example is given:

EXAMPLE

Three atomized aluminum bronze compositions were produced having the following composition:

(1)88% Cu—10% Al—2% Fe
(2)83% Cu—10% Al—2% Fe—5% Ni
(3)78% Cu—10% Al—2% Fe—10% Ni

These powders were employed to produce an overlayer on a bond coat deposited on a 1020 steel substrate. The particle size was minus 140 mesh to plus 325 mesh.

The bond layer was produced by spraying an agglomerated powder of the Ni-Al system containing 6% Al and 94% Ni, the aluminum powder being adhesively bonded to the nickel powder with a resin. The bond layer has a thickness of about 0.008 inch.

Following the laying down of the bond coat, alloy powders (1), (2) and (3) above were sprayed using the gravity fed torch shown in FIG. 2, the coating thickness being about 0.08 inch.

The coatings were then tested for hardness using a standard Rockwell testing machine and a standard Tukon microhardness testing machine using the Knoop indenter (KHN). The Knoop hardness readings were obtained directly on the sprayed particle in the coating by locating the area of the particle or particles under the microscope. Ten hardness readings were obtained for each alloy. The results obtained are as follows:

| Alloy No. | Composition | Average Rb** | Average KHN |
|---|---|---|---|
| (1) | 88% Cu-10% Al-2% Fe | 67.5 | 280 |
| *(2) | 83% Cu-10% Al-2% Fe-5% Ni | 93. | 428 |
| (3) | 78% Cu-10% Al-2% Fe-10% Ni | 53.5 | 230 |

*The invention
**Rockwell B hardness

Figure 1:
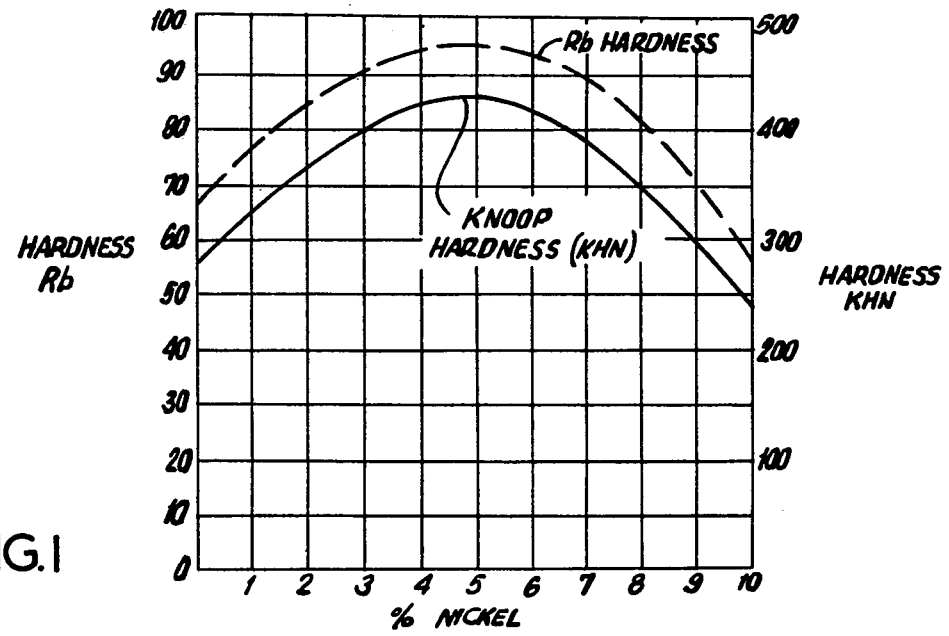
FIG. 1 is a set of curves showing the effect of nickel on increasing the hardness of the aluminum bronze alloy.

As will be noted from FIG. 1, a marked improvement in hardness is obtained in the coating of the invention containing 5% Ni as compared to Alloy No. (1) with no nickel and Alloy No. (3) containing 10% Ni. The improvement over Alloy (1) is over 37% for the Rockwell B hardness and over 50% for the Knoop hardness.

A metallographic examination of the microstructure of Alloy No. (2) (the INVENTION) showed excellent particle-to-particle bonding of the sprayed aluminum bronze alloy and the coating integrity was very good.

The hardness trends relative to the nickel content is shown in FIG. 2, peak hardness results being obtained with 5% nickel. Broadly speaking, the nickel content may range from about 2% to 8% and, more preferably, from about 4% to 6%.

It is not clearly understood why the hardness falls off as the nickel content approaches 10%. It is believed that the markedly improved hardness obtained between 2 and 8% nickel may be related to the precipitation of hard phases which are not visible under a microscope under ordinary light. However, this is not certain. Whatever the reasons, the results are surprising and unexpected.

Subsequent tests relating to wear resistance showed that the addition of nickel does not adversely affect the resistance of the coating to wear.

WEAR TESTING

Figure 3:
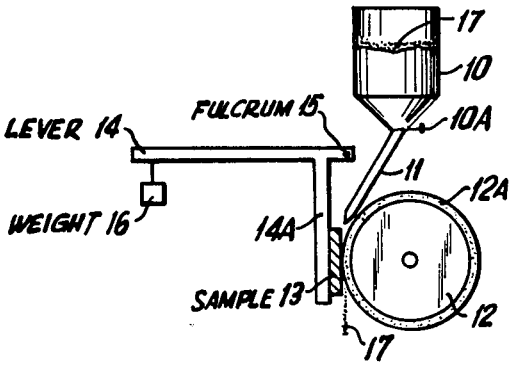
FIG. 3 is a schematic of a device for use in measuring resistance to wear of deposited coatings.

Wear tests were conducted in duplicate on Alloys No. (1) and No. (2), wherein No. (2) (the INVENTION) was compared to the wear characteristics of the No. (1) alloy. The wear testing device is illustrated schematically in FIG. 3 and comprises a lever 14 having two legs at right angles to each other, one of the legs 14A carrying a sample 13 which bears against a rotating wheel 12 as shown, the lever being pivotally mounted at fulcrum 15. The area of the sample is 3 square inches, the contact area with the wheel being 1 square inch.

The free end of lever arm 14 supports a weight 16 which is located sixteen inches from the pivot end thereof for applying pressure to sample 13 in contact with the periphery of rubber wheel 12A.

The hopper contains hard particles of material, e.g. silica ($SiO_2$) or silicon carbide (SiC) and the like which are fed via the opening of gate 10A down chute 11 which is inclined relative to the horizontal axis of the lever arm and extends to the surface of the sample and is adapted to feed a steady flow of hard particles to said sample 13 mounted on leg 14A in tangential contact with rubber wheel 12A by virtue of weight 16, the hard particles being fed into the bite formed between the contacting surfaces of the sample and the wheel, the hard particles 17 being shown emitting downwardly therefrom after passing through the bite area in frictional contact with the surface of the sample. The following conditions were employed in the tests.

Coarse abrasive test:(−20+40 mesh sand)

Test time:15 minutes

Flow rate of sand:1 lb/min.

The average of duplicate samples are given as follows:

| | 88% Cu-10% Al-2% Fe | 83% Cu-10% Al-2% Fe-5% Ni |
|---|---|---|
| Wt. Loss (grs) | 1.25 | 1.08 |
| Wear Factor | 6.8 | 7.85 |

The wear factor is determined as the reciprocal of the volume loss of the coating during testing, the loss in weight (in grams) being converted to cubic centimeters. The higher the wear factor value, the greater is the resistance to wear. As will be noted, the wear resistance is not adversely affected by the addition of nickel but, on the contrary, is improved. The wear factor of the alloy with 5% Ni improved by over 15% relative to the alloy without nickel.

A shaft of 1020 steel coated with the No. 2 alloy (the invention) machined very smoothly with a carbide tip cutting tool as evidenced by a smoothness determined in microinches of 20 to 25 RMS (root mean square).

Broadly, the aluminum bronze alloy may be applied to ferrous metal substances, e.g. steel, cast iron, etc., as well as to non-ferrous metals, e.g. monel (67% Ni–33% Cu) and other metal substrates.

It is clearly apparent that adding nickel over the controlled range of 2% to 8% and preferably 4% to 6% to aluminum bronze alloy provides markedly improved results with regard to increase in hardness while maintaining resistance to wear and resistance to galling for coating produced from said aluminum bronze alloy.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What I claim is:

1. A flame spray method of producing an aluminum bronze alloy as-sprayed coating on a metal substrate, said coating characterized by improved hardness and resistance to oxidation and resistance to galling which comprises, spraying a preliminary coating of a bonding metal on said metal substrate, and then spraying said aluminum bronze alloy as an atomized free flowing powder on said bonding metal coating, said atomized aluminum bronze alloy powder consisting essentially of up to about 3% Fe, about 6% to 12% Al, about 4% to 6% Ni, and the balance essentially copper, said free flowing powder having an average particle size ranging substantially from about minus 100 mesh to plus 325 mesh, whereby a hard adherent coating of said aluminum bronze alloy is provided on said metal substrate of hardness at least 10% higher than the hardness of the as-sprayed alloy without nickel.

* * * * *